US005967100A

United States Patent [19]

Firey

[11] Patent Number: 5,967,100

[45] Date of Patent: Oct. 19, 1999

[54] COMBUSTION PROCESS FOR COMPRESSION IGNITION ENGINES

[76] Inventor: Joseph C. Firey, P.O. Box 15514, Seattle, Wash. 98115

[21] Appl. No.: 09/010,011

[22] Filed: Jan. 21, 1998

Related U.S. Application Data

[63] Continuation-in-part of application No. 08/838,720, Apr. 9, 1997.

[51] Int. Cl.[6] ..... F02B 7/00

[52] U.S. Cl. ..... 123/27 GE; 123/274; 123/279

[58] Field of Search ..... 123/27 GE, 526, 123/255, 267, 274, 48 D

[56] References Cited

U.S. PATENT DOCUMENTS

| | | | |
|---|---|---|---|
| 2,561,598 | 7/1951 | Schowalter | 123/27 GE |
| 2,562,511 | 7/1951 | Schowalter | 123/27 GE |
| 2,635,589 | 4/1953 | Klinger | 123/27 GE |
| 2,723,653 | 11/1955 | Blake et al. | 123/27 GE |
| 2,767,691 | 10/1956 | Mengelkamp et al. | 123/27 GE |
| 2,799,255 | 7/1957 | Gehres | 123/27 GE |
| 2,928,382 | 3/1960 | Hug | 123/27 GE |
| 3,136,305 | 6/1964 | Kenworthy | 123/27 GE |
| 3,407,790 | 10/1968 | Antonsen et al. | 123/27 GE |
| 4,091,774 | 5/1978 | Kamiya | 123/255 |
| 4,202,300 | 5/1980 | Skay | 123/48 D |
| 5,009,207 | 4/1991 | Merritt | 123/279 |
| 5,081,969 | 1/1992 | Long, III | 123/274 |
| 5,101,776 | 4/1992 | Ma | 123/48 D |

*Primary Examiner*—Erick R. Solis

[57] ABSTRACT

A combustion process is described, suitable for use in piston internal combustion engines, wherein two separate mixtures are used, one fuel leaner and one fuel richer than the minimum ignition delay mixture ratio. When the richer mixture is injected into the leaner mixture, interdiffusion creates zones readily compression ignitable. Burning is thusly initiated, which subsequently completes the combustion of the combined air fuel mixture. Very fuel lean overall mixture ratios can be utilized in this way to reduce undesirable exhaust emissions and to increase engine efficiency.

10 Claims, 6 Drawing Sheets

COMBUSTION PROCESS FOR COMPRESSION IGNITION ENGINES

CROSS REFERENCES TO RELATED APPLICATIONS

This application is related to my earlier filed U.S. patent application entitled, "Air fuel Vapor Stratifier", and is a continuation in part of my earlier filed application, Ser. No. 08/838,720,entitled "Compression Ignition Engine Combustion Process."

BACKGROUND OF THE INVENTION

1. Field of the Invention

This invention is in the field of combustion processes for piston internal combustion engines, and particularly for such engines using compression ignition to initiate the burning of the principal air fuel mixture.

2. Description of the Prior Art

In addition to conventional diesel engines, some natural gas engines also use compression ignition to initiate the burning of the air fuel mixture. In these natural gas engines, a very fuel lean mixture of natural gas in air is the principal air fuel mixture for the engine. This lean principal mixture is difficult to ignite with a conventional electric spark and, when thusly spark ignited, burns slowly, thus reducing the engine efficiency. Liquid diesel fuel can be injected into the highly compressed lean principal mixture and the compression ignition of this injected diesel fuel ignites the lean principal mixture at many different places. By thusly starting burning at many places, the burning of the lean principal mixture can be completed in a short time interval and hence with good engine efficiency. In this way lean principal natural gas in air mixtures can be used efficiently and are known to have lower emissions of some undesirable exhaust components than stoichiometric mixtures.

All prior art compression ignition engines inject a liquid fuel into the engine combustion chamber. After injection and atomization a portion of the liquid fuel evaporates and diffuses into the surrounding air or natural gas in air mixture. In consequence almost the entire range of air to fuel ratios is created in separate regions surrounding the injected and atomized liquid fuel. Some of these separate regions will have an air to fuel ratio at which the compression ignition delay time is a minimum and these will be the regions first to ignite. Burning is thus initiated in these regions whose air to fuel ratio is that for minimum compression ignition delay time. Burning progresses from these first to ignite regions into those other regions containing both evaporated fuel and air as needed to sustain burning. Those liquid fuel portions, unevaporated at the time of initiation of burning, will thus become surrounded with very high temperature burned gases largely devoid of oxygen. These initially unevaporated liquid fuel portions will subsequently evaporate quickly, and be heated to a high temperature, but will have difficulty finding the oxygen needed for burnup. In consequence these fuel portions are partially converted to soot which is very slow to burn. While some of this soot will subsequently burn slowly within the engine, other soot portions will survive unburned into the engine exhaust as undesirable smoke emissions. Such exhaust smoke is undesirable, not only as being unsightly, but also as causing reduced engine efficiency, since not all fuel is burned. Additionally these soot particles aggravate the engine exhaust odor problem by absorbing, and hence concentrating, odor creating exhaust components, such as formaldehyde.

It would be very desirable to devise a compression ignition process, for use in internal combustion engines, which produced little or no soot.

3. Definitions

The term compression ignition combustion process is used herein and in the claims to mean a process wherein a mixture of air and fuel is sufficiently compressed that it self ignites, in one or more regions, without an external ignition source, and combustion can be initiated in this way.

The term piston internal combustion engine is used herein and in the claims to mean an internal combustion engine of the piston and cylinder type, or equivalent, such as the Wankel engine type, and comprising a variable volume chamber enclosed by the piston and cylinder. Gases contained within this variable volume chamber are alternately compressed and expanded as the chamber volume is decreased and increased. A piston internal combustion engine can be of the two strokes per cycle type or of the four strokes per cycle type. Additional details of piston internal combustion engines are described in the background portion of my earlier filed application entitled, "Displacer Jet Igniter", Ser. No. 08/368,093, FILED Jan. 3, 1995, and this material is incorporated herein by reference thereto.

The term, principal air fuel mixture, fuel leaner than the minimum compression ignition delay time fuel air ratio, herein and in the claims, encompasses such mixtures containing fuel, and also air to which no fuel has been added.

SUMMARY OF THE INVENTION

The engine combustion process of this invention is useable in piston internal combustion engines which additionally comprise a separate displaceable igniter mixture volume, with a flow connection to the variable volume chamber of the internal combustion engine. A compressed first principal air fuel mixture, which can be air alone, is placed within the variable volume chamber, and a compressed igniter air fuel mixture is created within the igniter mixture volume. The principal air fuel mixture is fuel leaner, and the igniter air fuel vapor mixture is fuel richer, than the minimum compression ignition delay fuel air ratio. During compression the igniter air fuel mixture is displaced out of the igniter mixture volume and is injected into the principal air fuel mixture to create a combined air fuel mixture within the variable volume chamber. These two different air fuel mixtures interdiffuse into each other across the mixture region boundaries. Regions are thusly created, by this interdiffusion, whose fuel to air ratios lie between that of the fuel lean principal mixture, and that of the fuel vapor rich igniter mixture, and include regions whose fuel to air ratio is the minimum compression ignition delay fuel to air ratio. Continued compression of the combined air fuel mixture causes compression ignition to take place within those regions whose fuel to air ratio is at or near to the minimum compression ignition delay ratio. The engine burning process is thusly initiated in several small regions, and this burning then continues throughout the burnable portions of the combined mixture. The engine cycle is then continued by expanding the burned combined mixture and exhausting the burned and expanded gases out of the variable volume chamber, so that the next cycle can commence.

The injected igniter mixture is a mixture of fuel vapor in air, and is not an injected liquid fuel mass. As a result little or no soot will be formed from the over rich regions, since some oxygen will be available for burning within each such rich region. This is a principal beneficial object of the compression ignition engine combustion process of this invention, that soot formation is largely or completely prevented. Thus the smoke and odor problems of prior art compression ignition engines are reduced or avoided altogether.

DESCRIPTION OF THE PREFERRED EMBODIMENTS

I. Internal Combustion Engines

The combustion process for compression ignition engine of this invention is useable on piston internal combustion engines comprising:

1. A variable volume chamber, enclosed by a piston, moveable within a cylinder, the piston being driven by an internal combustion engine mechanism to vary the volume of this chamber;
2. The internal combustion engine can be of the two strokes per cycle, or of the four strokes per cycle, type and comprise the necessary intake and exhaust systems as are well known in the prior art;
3. The piston internal combustion engine additionally comprises a displaceable igniter mixture volume, enclosed by a displacer piston moveable within a displacer cylinder. This displaceable igniter mixture volume is flow connected to the variable volume chamber so that the displacer piston can displace the contents of the igniter mixture volume into the variable volume. Examples of displaceable igniter mixture volumes are described in my related U.S. patent application, Ser. No. 08/368,093, entitled "Displacer Jet Igniter", filed Jan. 3, 1995, and also in my related U.S. patent application entitled "Air Fuel Vapor Stratifier", and this descriptive material is incorporated herein by reference thereto;

II Compression Ignition Process Steps

Figure 1A:
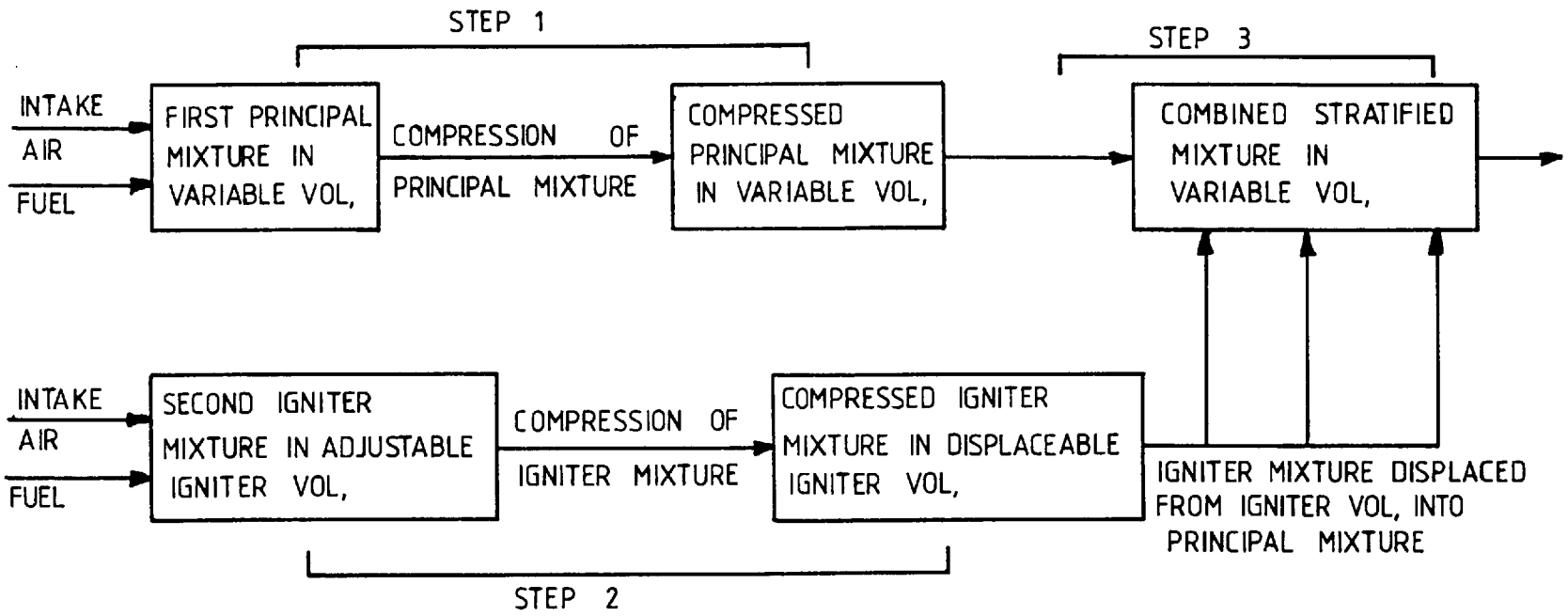
Figure 1B:
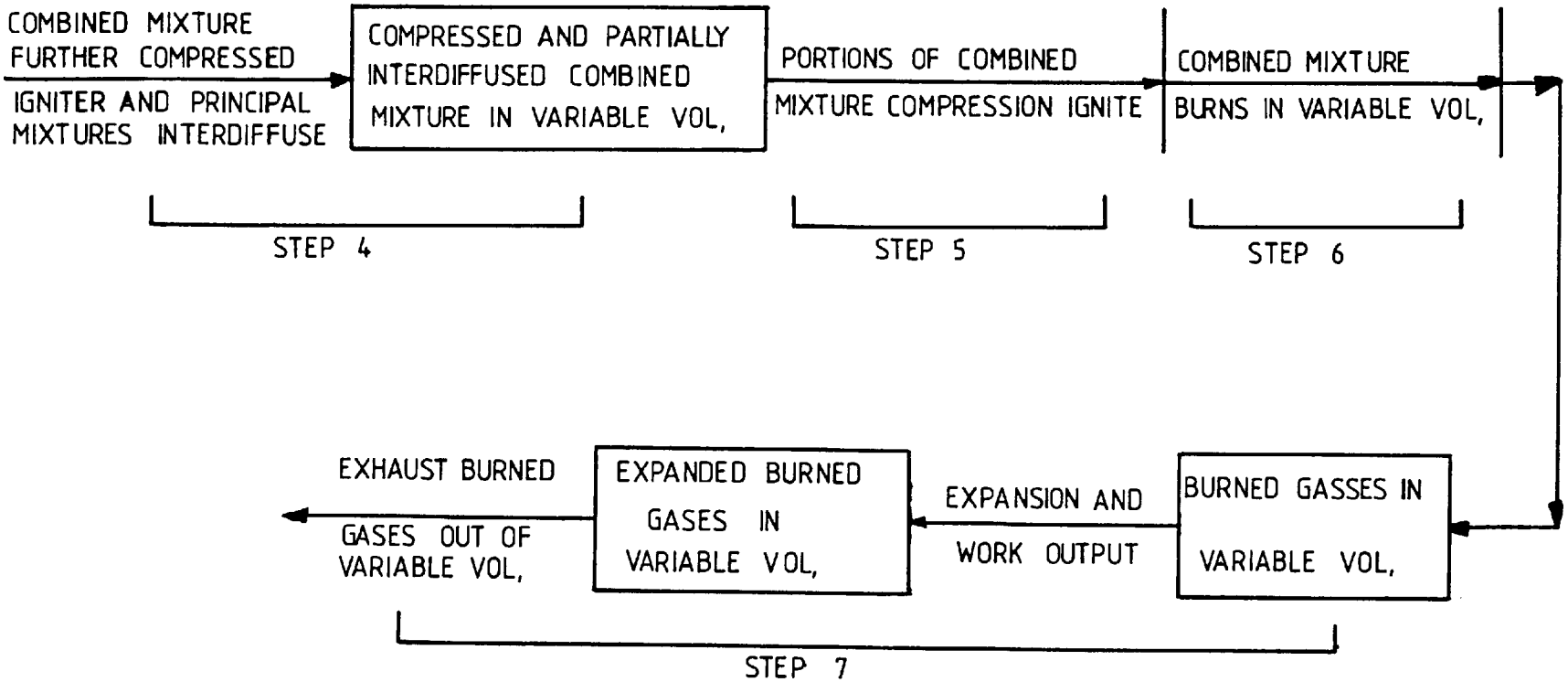

The compression ignition engine combustion process of this invention comprises the following steps:

1. At first principal air fuel mixture, which can be air alone, is created within the variable volume chamber. The air to fuel ratio of this first principal mixture is fuel leaner than the minimum compression ignition delay air to fuel ratio. This first principal mixture is compressed within the variable volume chamber. The first step is shown as step 1 on FIG. 1A.
2. A second igniter air fuel vapor mixture is created within the displaceable igniter mixture volume. The air to fuel vapor ratio of this second igniter mixture is fuel richer than the minimum compression ignition delay air to fuel ratio. This second igniter mixture is compressed within the igniter mixture volume. This second step is shown as step 2 on FIG. 1A.
3. The compressed second igniter air fuel mixture is injected into the compressed first principal air fuel mixture, by being displaced out of the displaceable igniter mixture volume during the engine compression process. In this way a combined compressed air fuel mixture is created within the variable volume chamber. This third step is shown as step 3 on FIG. 1A.
4. The combined air fuel mixture may be further compressed within the variable volume chamber. Concurrently portions of the two different air fuel mixtures will interdiffuse into each other, due to the concentration gradients of fuel and air existing across the contact surfaces between the injected second igniter air fuel mixture and the first principal air fuel mixture. This interdiffusion will create mixture regions whose air fuel ratio lie between that of the rich igniter mixture, and that of the lean principal mixture, and all of these intermediate mixture ratios will be present in different regions. Hence some regions will be created whose air to fuel ratio is at or near to the minimum compression ignition delay air fuel ratio. This fourth step is shown as step 4 on FIG. 1B.
5. The further compression of the combined and interdiffused mixture causes compression ignition to occur first in these regions whose air to fuel ratio is the minimum compression ignition delay air to fuel ratio. Burning of the combined mixture is initiated in this way. This fifth step is shown as step 5 on FIG. 1B.
6. The remaining burnable regions of the combined air fuel mixture are burned, either by being subsequently compression ignited, or by flame travel thereinto from previously ignited regions, or by a combination of flame travel and subsequent compression ignition. This sixth step is shown as step 6 on FIG. 1B.
7. The internal combustion engine cycle is completed by expanding the ignited and burned combined mixture, and exhausting the burned and expanded gases out of the variable volume chamber. The next engine cycle then follows. This seventh step is shown as step 7 on FIG. 1B.

III Creating the First Principal Mixture

Figure 3:
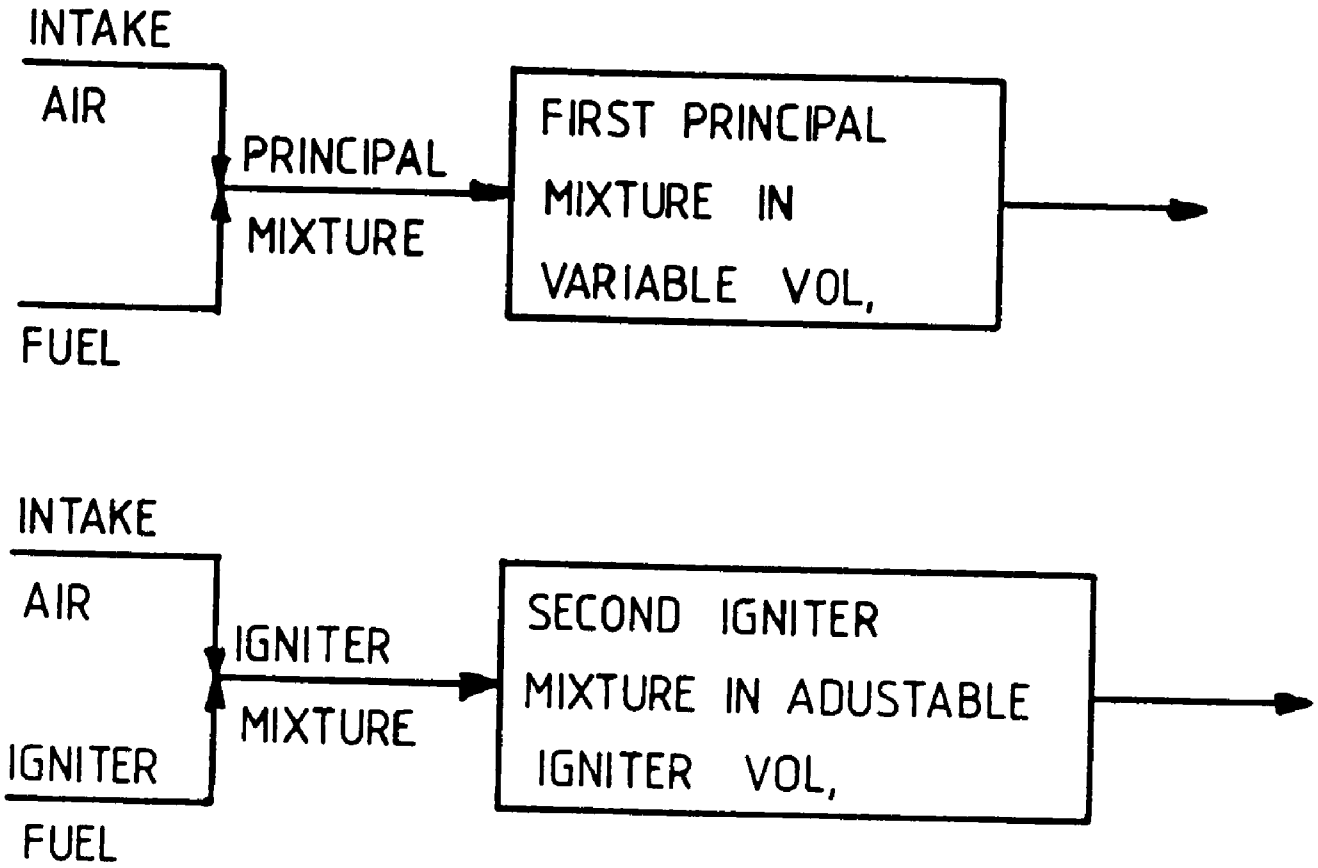
Figure 5:
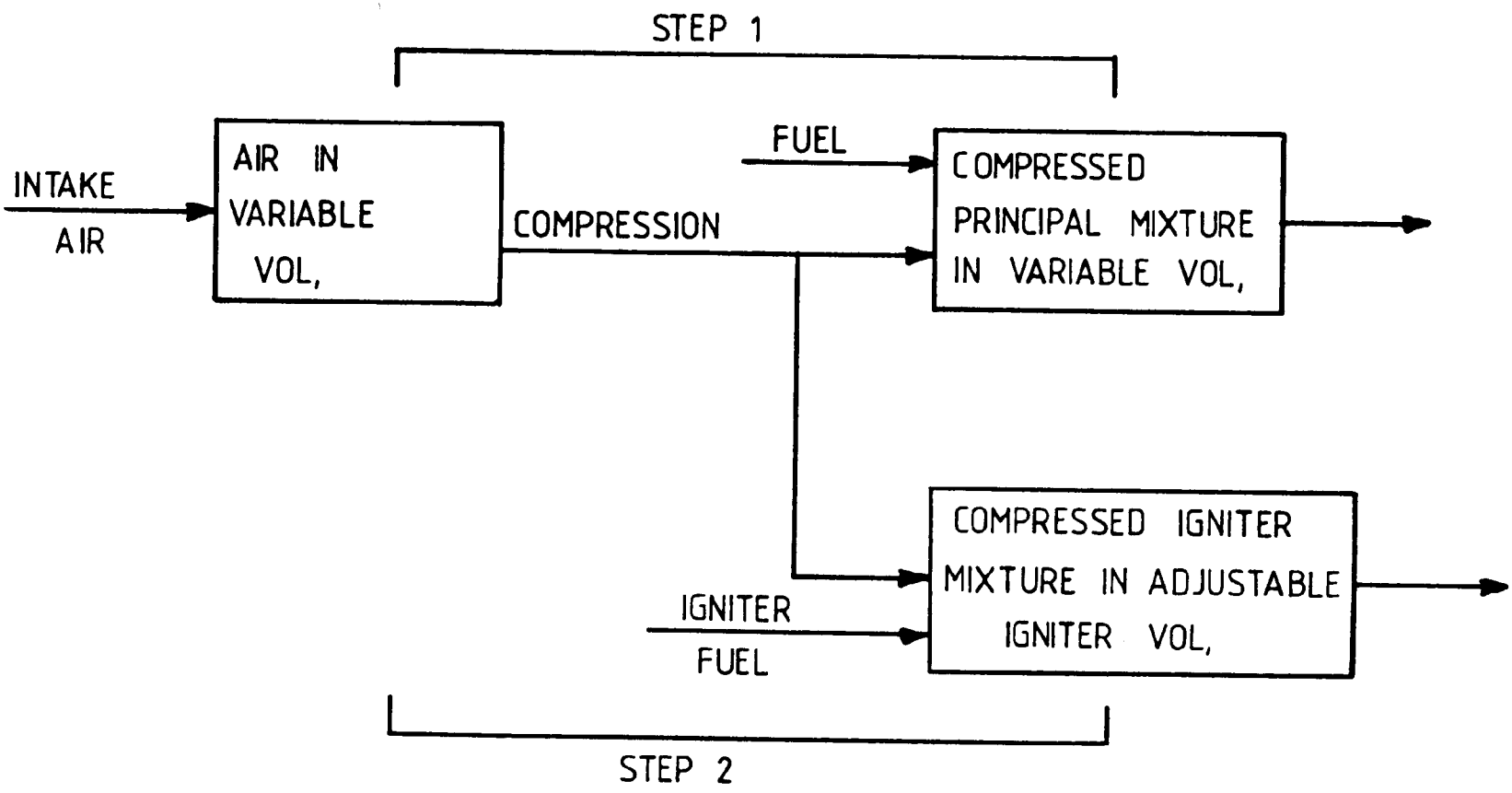

Various methods can be used to create the first principal air fuel mixture, and to place it inside the variable volume chamber, as, for example, the following:

1. A principal engine fuel, such as natural gas or gasoline, is mixed into a principal engine air mass, outside of the variable volume chamber, and the resulting principal air fuel mixture is then transferred into the variable volume chamber during the intake portion of the engine cycle: This alternate principal mixture preparation process is shown on FIG. 3.
2. A principal engine air mass is transferred into the variable volume chamber, during the intake portion of the engine cycle, and a principal engine fuel is injected into the variable volume chamber, to mix with the principal air mass, during the compression portion of the engine cycle: This alternate principal mixture preparation process is shown on FIG. 5.
3. For the purpose of this invention the first principal engine air fuel mixture is to be fuel leaner than the minimum compression ignition delay air to fuel ratio and can be air into which no fuel has been added;

IV Creating the Second Igniter Mixture

Figure 2:
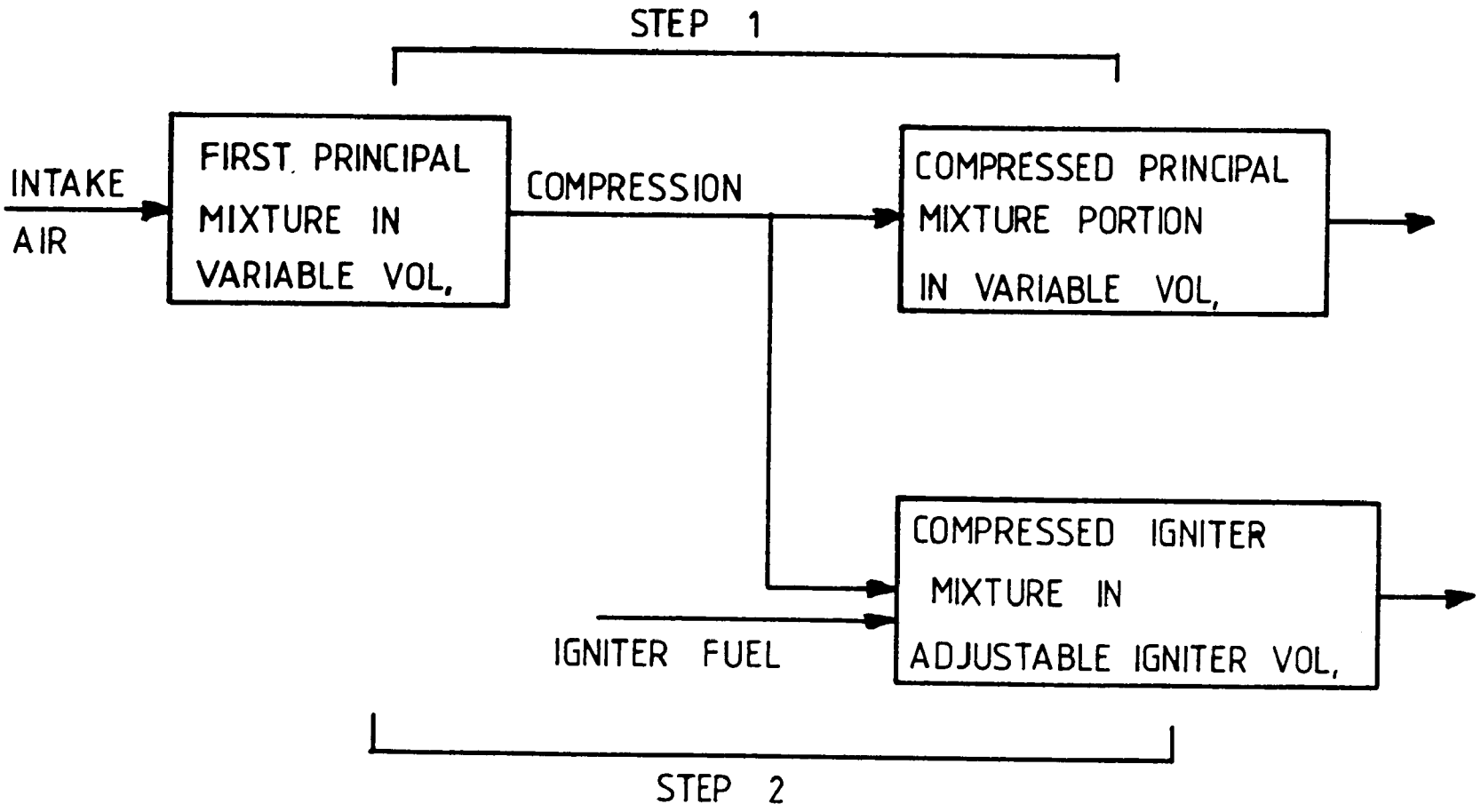

Various methods can also be used to create the second igniter air fuel vapor mixture, and to place it inside the igniter mixture volume, of which the following are examples:

1. An igniter fuel vapor is mixed into an igniter air mass, outside of the igniter mixture volume, and the resulting igniter air fuel vapor mixture is then transferred into the igniter mixture volume preferably at some time during the intake and compression portions of the engine cycle: This alternate igniter mixture preparation process is shown on FIG. 3.
2. A portion of the principal engine air fuel mixture is transferred into the igniter mixture volume during the compression portion of the engine cycle. An igniter fuel vapor is added as an enrichening fuel into this portion of principal air fuel mixture, within the igniter mixture volume, preferably during the compression portion of the engine cycle, to create the second air fuel vapor mixture therein, which will be fuel richer than the first principal mixture. This alternate preferred igniter mixture preparation process is shown on FIG. 2.

3. The fuel portion of the second igniter mixture is preferably to be largely in the vapor state when in the displacer volume, and is to be admixed with some air portions, either outside or inside the displacer volume, in order to minimize soot formation from liquid fuel portions which cannot be premixed with air;
4. For the purposes of this invention the second igniter air fuel vapor mixture is to be fuel richer than the minimum compression ignition delay air to fuel ratio;

V. Compression Ignition

When adequately compressed, many air fuel mixtures will self ignite after an ignition time delay interval. The duration of this ignition time delay varies with air to fuel mixture ratio, and is shorter as compression pressure increases. Such compression ignition can occur over a very wide range of air to fuel ratios, both fuel leaner than, and fuel richer than, the chemically correct air fuel ratio for complete fuel burnup. The shortest ignition time delay usually occurs at or near this chemically correct mixture ratio, the ignition time delay being longer for mixtures both fuel leaner and fuel richer than this minimum compression ignition time delay air to fuel ratio. These well known characteristics of the compression ignition process are described, for example, in the reference, "The Internal Combustion Engine", C. F. Taylor and E. S. Taylor, Intl. Textbook Co., second edition, 1961, page 120–123, and FIGS. 6–14.

To efficiently utilize the igniter air fuel mixture, for the igniting of the fuel lean principal air fuel mixture, all compression ignitions are to take place only within the variable volume chamber. For this reason, the igniter air fuel mixture is injected into the principal air fuel mixture, within the variable volume chamber, prior to completion of the engine compression stroke. This early injection of the igniter mixture, to create the combined air fuel mixture, provides a time interval for interdiffusion of the two different mixtures to occur, and create regions whose mixture ratio is that for minimum compression ignition delay. The subsequent continued compression causes compression ignition to take place, first within these interdiffused regions, and the burning of the combined air fuel mixture is thusly initiated.

VI. Burning After Initiation

In engine experiments where the entire combined air fuel mixture is of nearly the same air to fuel ratio, and hence of the same ignition delay, the occurrence of compression ignition can be extremely violent, since almost the entire mixture reacts fully in a very short time period. These violent compression ignitions create high engine noise levels, and can cause mechanical damage to the engine. To avoid such violent burning, compression ignition delay gradients can be created within the combined air fuel mixture, so that different regions, having different ignition delay time intervals, react at different times. In this way the burning takes place over a long time interval and is gradual and less violent. Such gradients of compression ignition time delay can be created by use of gradients of air to fuel ratio, or gradients of types of fuel present, or gradients of both fuel type and air to fuel ratio.

Conventional diesel engines achieve reasonably gradual compression ignition by creating gradients of air to fuel ratio around each atomized liquid particle, and hence by creating delay gradients therein. Additionally, the liquid fuel is injected and atomized over an appreciable time interval. In consequence many separate regions are created, dispersed in time and position within the engine combustion chamber. Compression ignition thus occurs at different times in different places in separate and small mixture regions. Thus the burning is reasonably gradual and noise levels are acceptable.

Figure 4:
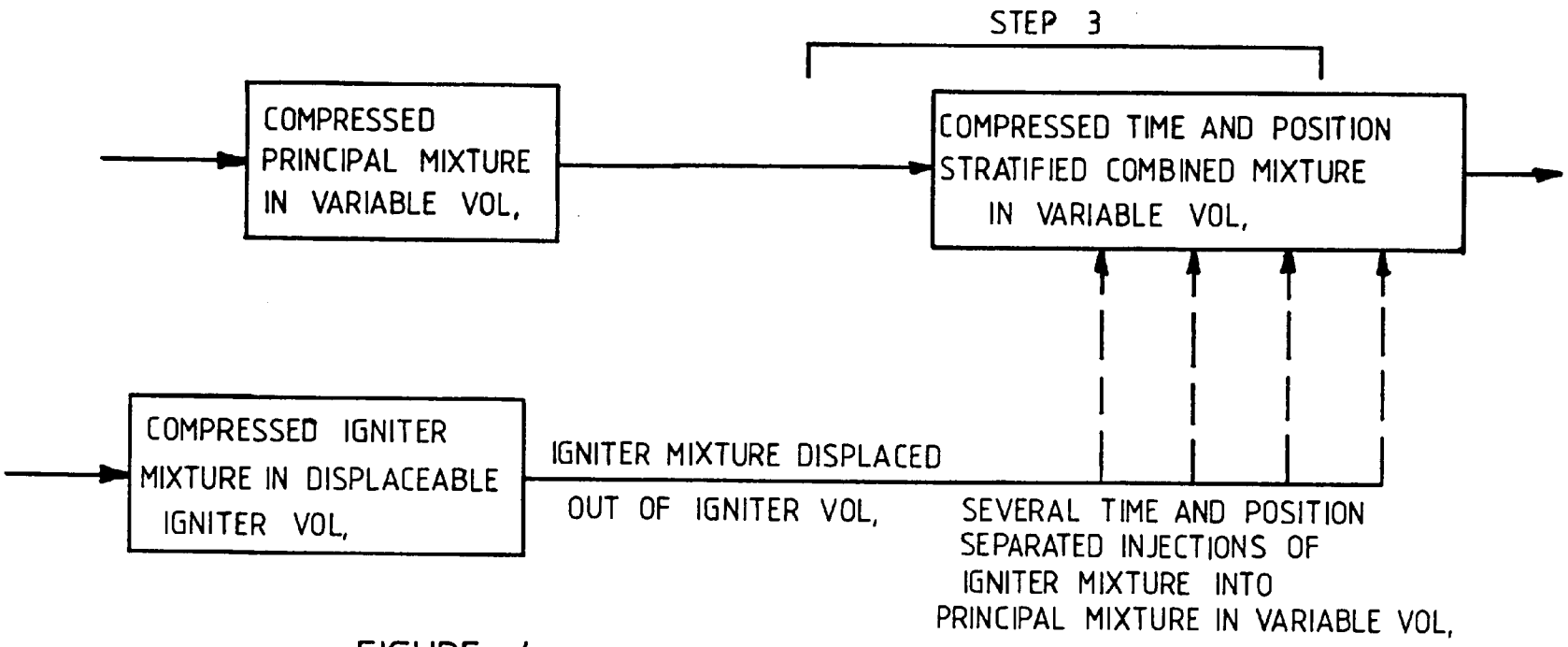

In similar fashion, for the purposes of this invention, it is preferable to inject the igniter mixture into the principal mixture in-several small injections, separated in time of injection, and place of injection, into the principal mixture. Examples of apparatus suitable for carrying out such time and position separated injections of igniter mixture into the principal mixture are described in my earlier filed U.S. patent application entitled "Air Fuel Vapor Stratifier", and this material is incorporated herein by reference thereto. This preferred process for injecting the igniter mixture into the principal mixture in the variable volume chamber is shown as step 3 in FIG. 4.

The principal air fuel mixture can be caused to rotate within the variable volume chamber, as by use of shrouded intake valves, or use of suitable air intake manifold geometry. Time separated injections of igniter mixture, out of the igniter mixture volume, and into a principal mixture which is rotating relative to the igniter mixture volume, may thus create injections which are also position separated within the principal mixture.

Air fuel ratio stratification, within the first principal engine air fuel mixture, and also within the second igniter air fuel mixture, can be used to create compression ignition time delay gradients, in addition to those resulting from the injecting of the igniter mixture into the principal mixture. These additional delay gradients, when sufficiently large, can also function to reduce the violence of the compression ignition process. Usual speeds of internal combustion engines are such, that almost all air fuel mixtures used in engines are at least partially air fuel ratio stratified, since the time available for interdiffusion of fuel molecules into air molecules is very short. Examples of methods for creating large delay gradients in air fuel mixtures are described in my following issued U.S. patents: U.S. Pat. No. 4,147,137; U.S. Pat. No. 4,205,647; U.S. Pat. No. 4,425,892; U.S. Pat. No. 4,848,302.

VII. Fuel Heating Value Ratio of the Mixtures

The fuel heating value ratio of principal air fuel mixture to igniter air fuel mixture is defined as follows:

$$(FHVR) = \frac{\text{Principal Mixture Energy Per Cycle}}{\text{Igniter Mixture Energy Per Cycle}}$$

$$(FHVR) = \frac{1}{(AR)}\frac{(EE)}{(EI)}$$

$$(AR) = \frac{\text{Igniter mixture-air mass per cycle}}{\text{Principal mixture air mass per cycle}}$$

$(EI)$ Heater value of igniter mixture per unit mass of igniter air;

$(EE)$ = Heating value of principal mixture per unit mass of principal air;

A low value of FHVR can be used to yield more rapid burnup when the principal air fuel mixture contains fuel, but requires use of a relatively greater amount of igniter fuel, which may be expensive. The optimum value of FHVR is best measured experimentally, using various optimization criteria, such as the following example criteria:

1. Where igniter fuel is the same as the principal engine fuel, maximum engine fuel efficiency could be an appropriate criterion;
2. Where igniter fuel is the same as the principal engine fuel, minimum emissions of undesirable exhaust components could be an alternative criterion;
3. Where igniter fuel was more costly than the principal engine fuel, minimum overall fuel cost per unit of engine work out put could be an appropriate criterion.

VIII. Use of Differing Fuels

When the principal engine fuel is reasonably readily compression ignitable, as with low or moderate octane number gasoline, it will usually be preferred to use the same fuel also as the igniter fuel. But some commonly used principal engine fuels, such as natural gas, are difficult to compression ignite, even at compression ratios which create severe bearing loads. For these difficult to compression ignite principal fuels, it may be preferred to use a more readily compression ignitable, and differing, fuel as igniter fuel. For example, with natural gas as a principal engine fuel, the igniter fuel, or igniter fuel enrichener, could be a low octane number gasoline, such as a straight run gasoline, or a high cetane number diesel fuel.

When the igniter fuel, or igniter fuel enrichener, is of low vapor pressure, as with diesel fuel, apparatus to evaporate this fuel can be used, such as a liquid fuel evaporator for enrichening fuel, or an air heater for use in creating separate igniter air fuel vapor mixtures. In these cases the process step for creating the second igniter air fuel vapor mixture is preceded by a process step for evaporating igniter fuel or igniter fuel enrichener.

IX. Displacer Volume Adjustment

The Cummins diesel engine fuel injector, of the unit injector type, as described in the reference, "Internal Combustion Engines," L. C. Lichty, 6th Ed., 1951, McGraw Hill, page 261, FIG. 184, uses a displacer piston and displacer volume to inject a mixture of air and fuel into the variable volume chamber of a diesel engine. This Cummins injector process thus resembles the process of this invention but uses a fixed displacer volume, and thus the air quantity inside the displacer volume is fixed and very small. In consequence the igniter mixture is exceedingly fuel rich resulting in the formation of appreciable soot during combustion.

To avoid compression ignition of the igniter air fuel mixture, while yet inside the displacer volume prior to injection, the compression ignition time delay interval of this mixture needs to at least exceed the total residence time this mixture remains inside the displacer volume during each engine cycle. As engine speed increases, air fuel mixtures can be used whose compression ignition time delay interval is shorter. For the same igniter fuel, such shorter compression ignition time delay intervals can be achieved by use of igniter mixtures which are fuel leaner, while yet remaining fuel richer than the minimum compression ignition time delay air fuel ratio. Such fuel leaner igniter mixtures will generally create less exhaust soot than would richer igniter mixtures. These fuel leaner igniter mixtures can be created by adjusting the volume of the displacer volume and hence adjusting the air quantity therein;

In some engine applications, the fuel in the igniter air fuel mixture may be a significant portion or even the entire portion of the fuel supplied to the engine. In such applications, since fuel quantity is necessarily proportioned to required engine torque output, adjusting the fuel air ratio of the igniter mixture can be accomplished by adjusting the air quantity inside the displacer volume. Examples of apparatus, comprising means for adjusting the displacer volume, and hence the air quantity of the igniter air fuel mixture, are described in my earlier filed U.S. patent application entitled, "Air Fuel Vapor Stratifier". Such use of air alone as the principal mixture in the variable volume chamber is shown on FIG. 2.

The preferred combination of process steps will vary with the type of engine and its intended use. For example, an engine intended to run on diesel fuel alone, would preferably use the process steps 1 and 2, illustrated in FIG. 2 together with the process step 3, illustrated in FIG. 4. On the other hand, an engine intended to run on natural gas as principal fuel, with diesel fuel as igniter fuel, might preferably use process steps 1 and 2, illustrated in FIG. 5, together with process step 3 illustrated in FIG. 4.

X. Combination Combustion Process

The compression ignition engine combustion process of this invention can be used as the sole combustion process for an engine, or can be used in combination with a normal flame combustion process. A portion of the combined air fuel mixture can be ignited by a spark or flame jet and then burn by normal flame progression therethrough, while other portions are compression ignited and burn by the process described hereinabove. Such a combination combustion scheme can be used for suppression of knock and for improvement of engine efficiency, as described in my related U.S. patent application entitled "Air Fuel Vapor Stratifier", and this material is incorporated herein by reference thereto.

Having thus described my invention what I claim is:

1. A combustion process for compression ignition engines, for igniting and burning, at least a portion, of the air fuel mixture of each cycle of a piston internal combustion engine comprising a variable volume chamber and a displaceable igniter mixture volume, said process comprising the steps of:

creating a compressed first principal air fuel mixture inside said variable volume chamber, the air to fuel ratio of said first principal air fuel mixture being fuel leaner than the minimum compression ignition delay air to fuel ratio and said first principal air fuel mixture can have a fuel to air ratio of zero;

creating a compressed second igniter air fuel vapor mixture inside said displaceable igniter mixture volume, by evaporating liquid portions of said igniter fuel;

adjusting the air to fuel ratio of said igniter air fuel vapor mixture, to be fuel richer than the minimum compression ignition delay air to fuel ratio, and to be greater than zero, by adjusting the air quantity in said second igniter air fuel vapor mixture inside said displaceable igniter mixture volume;

injecting said compressed second air fuel mixture into said compressed first air fuel mixture, whereby a combined compressed air fuel mixture is created within said variable volume chamber;

further compressing said combined compressed air fuel mixture while interdiffusing portions of said second air fuel mixture and said first air fuel mixture into each other, whereby regions are created, with air to fuel ratios between that of said fuel lean first air fuel mixture, and that of said fuel rich second air fuel mixture, and including regions whose air to fuel ratio is the minimum ignition delay air to fuel ratio;

compression igniting those regions whose air to fuel ratio is the minimum ignition delay air to fuel ratio;

burning said ignited combined air fuel mixture;

expanding said ignited and burned combined air fuel mixture;

removing most of said burned and expanded combined air fuel mixture from said variable volume chamber;

repeating said combustion process for compression ignition engines.

2. A combustion process for compression ignition engines, as described in claim 1, wherein said steps of creating a compressed first principal air fuel mixture, and of creating a compressed second igniter air fuel mixture, comprise:

mixing a principal engine fuel into a principal engine air mass to create a first principal air fuel mixture whose air to fuel ratio is fuel leaner than the minimum compression ignition delay air to fuel ratio;

mixing an igniter fuel vapor into an igniter air mass to create a second air fuel vapor mixture whose air to fuel ratio is fuel richer than the minimum compression ignition delay air to fuel ratio, and is greater than zero;

placing said first air fuel mixture inside said variable volume chamber;

placing said second air fuel mixture inside said igniter mixture volume;

compressing said first air fuel mixture within said variable volume chamber;

compressing said second air fuel mixture within said igniter mixture volume.

3. A combustion process for compression ignition engines, as described in claim 1, wherein said steps of creating a compressed first principal air fuel mixture, and of creating a compressed second igniter air fuel mixture, comprise:

placing a principal air mass inside said variable volume chamber;

mixing a principal engine fuel into said principal air mass inside said variable volume chamber to create a first air fuel mixture whose air to fuel ratio is fuel leaner than the minimum compression ignition delay air to fuel ratio;

transferring a portion of said first air fuel mixture into said igniter mixture volume, while concurrently compressing said first air fuel mixture within said variable volume chamber;

mixing an igniter fuel vapor into that portion of said first air fuel mixture inside said igniter mixture volume to create a second air fuel vapor mixture whose air to fuel ratio is fuel richer than the minimum compression ignition delay air to fuel ratio, and is greater than zero, while concurrently compressing said second air fuel mixture within said igniter mixture volume.

4. A combustion process for compression ignition engines, as described in claim 1, wherein said steps of creating a compressed first principal air fuel mixture, and of creating a compressed second igniter air fuel mixture, comprise:

placing a principal air mass inside said variable volume chamber;

mixing a principal engine fuel into said principal air mass inside said variable volume chamber to create a first air fuel mixture whose air to fuel ratio is fuel leaner than the minimum compression ignition delay air to fuel ratio;

mixing an igniter fuel vapor into an igniter air mass to create a second air fuel vapor mixture whose air to fuel ratio is fuel richer than the minimum compression ignition delay air to fuel ratio, and is greater than zero;

placing said second air fuel mixture inside said igniter mixture volume;

compressing said first air fuel mixture within said variable volume chamber;

compressing said second air fuel mixture within said igniter mixture volume.

5. A combustion process for compression ignition engines, as described in claim 1, wherein said steps of crating a compressed first principal air fuel mixture, and of creating a compressed second igniter air fuel mixture, comprise;

mixing a principal engine fuel into a principal engine air mass to create a first principal air fuel mixture whose air to fuel ratio is fuel leaner than the minimum compression ignition delay air to fuel ratio;

placing said first air fuel mixture inside said variable volume chamber;

transferring a portion of said first air fuel mixture into said igniter mixture volume, while concurrently compressing said first air fuel mixture within said variable volume chamber;

mixing an igniter fuel vapor into that portion of said first air fuel mixture inside said igniter mixture volume to create a second air fuel vapor mixture whose air to fuel ratio is fuel richer than the minimum compression ignition delay air to fuel ratio, and is greater than zero, while concurrently compressing said second air fuel mixture within said igniter mixture volume.

6. A combustion process for compression ignition engines, as described in claim 1;

wherein said step of injecting said second air fuel mixture into said first air fuel mixture comprises:

a time sequence of at least two concurrent groups of space separated injections, each said group comprising at least two injections occurring concurrently into separate portions of said first air fuel mixture, said at least two groups occurring at different times.

7. A combustion process for compression ignition engines, as described in claim 1;

wherein said step of injecting said second air fuel mixture into said first air fuel mixture comprises;

a time sequence of at least two separate injections occurring at different times.

8. A combustion process for compression ignition engines, as described in claim 1;

wherein said step of injecting said second air fuel mixture into said first air fuel mixture comprises:

a group of at least two space separated injections occurring concurrently into separate portions of said first air fuel mixture.

9. A combustion process for compression ignition engines, as descried in claim 1;

wherein said first principal air fuel mixture is brought up to rotation, inside said variable volume chamber, relative to said igniter mixture volume.

10. A combustion process for compression ignition engines, as described in claim 7;

wherein said first principal air furl mixture is brought up to rotation, inside said variable volume chamber, relative to said igniter mixture volume.

* * * * *